US008684242B2

(12) United States Patent
Pomeroy et al.

(10) Patent No.: US 8,684,242 B2
(45) Date of Patent: Apr. 1, 2014

(54) HOLSTER WITH INTERCHANGEABLE COWLINGS

(75) Inventors: David A. Pomeroy, Jacksonville, NC (US); Michael E. Cole, Ste. Genevieve, MO (US); Scott V. Evans, Jacksonville, NC (US)

(73) Assignee: Eagle Industries Unlimited, Inc., Fenton, MO (US)

( * ) Notice: Subject to any disclaimer, the term of this patent is extended or adjusted under 35 U.S.C. 154(b) by 1659 days.

(21) Appl. No.: 12/032,142

(22) Filed: Feb. 15, 2008

(65) Prior Publication Data

US 2014/0061262 A1 Mar. 6, 2014

Related U.S. Application Data

(63) Continuation-in-part of application No. 11/307,092, filed on Jan. 23, 2006, now abandoned.

(51) Int. Cl.

| | |
|---|---|
| ***A45F 5/00*** | (2006.01) |
| ***B63B 57/00*** | (2006.01) |
| ***F41C 33/00*** | (2006.01) |
| ***F41C 33/02*** | (2006.01) |
| ***A45C 15/00*** | (2006.01) |
| ***A45F 4/00*** | (2006.01) |

(52) U.S. Cl.
USPC ..... 224/243; 224/575; 224/581; 224/583; 224/191; 224/193; 224/198; 224/238

(58) Field of Classification Search
USPC ..... 224/243, 191, 193, 198, 238
See application file for complete search history.

(56) References Cited

U.S. PATENT DOCUMENTS

| | | | | |
|---|---|---|---|---|
| 3,164,351 | A * | 1/1965 | Rembowski | 248/188.5 |
| 4,846,383 | A * | 7/1989 | Gallagher | 224/243 |
| 4,858,799 | A * | 8/1989 | Young | 224/243 |
| 5,570,830 | A * | 11/1996 | Nichols | 224/676 |
| 7,461,765 | B2 * | 12/2008 | French et al. | 224/243 |
| 7,850,053 | B2 * | 12/2010 | Rassias | 224/243 |
| 2002/0017541 | A1 * | 2/2002 | French | 224/244 |
| 2004/0187374 | A2 * | 9/2004 | Solinsky et al. | 42/146 |
| 2006/0011680 | A1 * | 1/2006 | Cook et al. | 224/243 |
| 2006/0156525 | A1 * | 7/2006 | Jenkins et al. | 29/407.1 |
| 2007/0181619 | A1 * | 8/2007 | Seyfert et al. | 224/196 |
| 2010/0219216 | A1 * | 9/2010 | Clark et al. | 224/243 |

* cited by examiner

*Primary Examiner* — Brian D Nash
*Assistant Examiner* — Derek Battisti
(74) *Attorney, Agent, or Firm* — Samuel Digirolamo; Husch Blackwell LLP

(57) ABSTRACT

A holster with interchangeable cowling members for reconfiguring the holster pocket to accommodate pistols of varying sizes including pistols with add-on attachments including a frame member forming at least a first portion of a holster pocket, a cowling member cooperatively associated with the frame member forming a second portion of the holster pocket, at least one slide member associated with one of the frame member and cowling member, at least one groove associated with the other of the frame member and cowling member, the groove being adaptable to receive the slide member for selective longitudinal movement therealong, and a latch device having a first portion cooperating with the frame member and a second portion cooperating with the cowling member and operable to selectively prevent relative movement therebetween. The groove, slide member and latch device releasably mount the cowling member to the frame member.

23 Claims, 4 Drawing Sheets

HOLSTER WITH INTERCHANGEABLE COWLINGS

CROSS REFERENCE TO RELATED APPLICATIONS

This application is a continuation-in-part of application Ser. No. 11/307,092 filed on Jan. 23, 2006, and hereby incorporates by reference the full disclosure of that application.

BACKGROUND OF THE INVENTION

The present invention generally relates to holsters for firearms with interchangeable cowlings. More particularly, the present invention relates to a holster device with interchangeable cowlings that allow a user to toollessly decouple a cowling member from the holster and toollessly couple a differently shaped cowling member to the holster, thus forming a differently shaped holster pocket.

Handguns have been carried in holsters by their owners for a few hundred years. Advances in holster design are not new. Different types of holsters have been created to suit the different needs of those carrying pistols. Duty Holsters, which include outside the waistband (OTW) holsters that typically attach to a belt or harness and are designed to be plainly visible, are used by law enforcement personnel and the military. Concealment holsters, which include inside the waistband (ITW) holsters, shoulder holsters, "belly band" holsters, pocket holsters, groin holsters and ankle holsters and are designed to be worn inconspicuously under clothing, are likewise popular with plain-clothes police officers and military personnel, as well as with civilians who wish to conceal and carry their firearm. Sporting holsters are designed to best suit the sport for which they are being used, and thus vary widely. For example, some sporting holsters are designed for the quickest possible release of the firearm (for quick-draw contests); some are designed for silent operation and maximum retention of the firearm (for hunting); and some are designed to prevent damage to the pistol carried therein.

Just as different holsters have evolved for different applications, pistols have evolved for use in different circumstances. Hunters may use larger caliber pistols, while competitors in accuracy and quick-draw competitions will likely use pistols that fire ammunition with less energy when fast repetitive shots are to be taken. Those who wish to conceal and carry their pistol may want a sidearm without a hammer (as the hammer can get caught in clothing), while many police officers often want to see the hammer cock back and fall as they pull the trigger so that the discharge of the cartridge is not startling or surprising.

Many people have multiple firearms—one for each situation in which they may find themselves. However, having many firearms typically requires having multiple holsters. Indeed, holsters typically have only one function—they hold a specific model or type of sidearm in the pocket of the holster until the firearm is needed by the user. All of the above listed types of holsters have proven useful in their fields performing just such a function. However, this singular function is also a limitation—holsters are typically designed to cradle only a single sidearm or very similar types of sidearms.

Further, most pistols are somewhat customizable with add-ons. Those who wish to use their pistol at night can have night sights (illuminated sights that allow users to properly align their sights on a target when the sights themselves cannot normally be seen) and/or a small under-barrel flashlight added to their pistol. Those who wish to know exactly where their pistol is aiming may wish to add a laser sight add-on to their pistol. Some police and military personnel now have video camera attachments on their weapons so that a record can be kept of exactly where the weapon was pointing at a given time.

Often, people with firearms utilize at least one of various accessories for each situation in which they may find themselves. However, having many sidearm accessories typically requires having multiple holsters, or having to refrain from attaching the desired accessory until the weapon can be carried in its holster to the location of use, at which point the accessory is installed in the field, or even sacrificing the fit of the weapon in the holster.

Similarly, those who work in law enforcement or the military often need to adapt to ever changing situations by supplementing their firearms with various accessories. It is highly impractical for such people to be unable to holster their supplemented sidearm every time an additional element is added, or to have to carry an additional holster and attempt to swap holsters in the field—typically not the easiest of processes when tools are needed.

Holsters are designed for specific circumstances and hold limited types of sidearms with a specific set of (or no) add-ons in the pocket of the holster until the firearm is needed by the user. When dealing with firearm owners with multiple pistols, each of which has multiple possible configurations with various accessories, or with police and military personnel, the holster's singular configuration can become a serious limitation.

Consequently, a need has long been felt for a holster that can be quickly and easily altered toollessly to accept multiple firearm models or multiple configurations of a single firearm.

SUMMARY OF THE INVENTION

One or more of the embodiments of the present invention overcomes many of the shortcomings and limitations of the prior art devices, and teaches the construction and operation of a holster with toollessly interchangeable cowlings. In the parent application Ser. No. 11/307,908, reference was made to a holster with "attachment points for other components such as an interchangeable cowling" (Paragraph [0006]) in which the mounting of the interchangeable cowling could "be accomplished in a conventional manner such as using conventional screws, rivets, and other appropriate fastening members" (Paragraph [0027]). An embodiment of the present invention provides a holster adapted for toolless coupling and decoupling a cowling member to the frame member of the holster.

In one embodiment, the holster is composed of a rigid polymer, or other suitable material, such that it is not easily deformable or destructible. At least one latch device secures a cowling member to the frame member of the holster forming a holster pocket of a certain configuration for holding a pistol of a particular configuration. Either the cowling member or the frame member has one or more grooves, while the other member has one or more respective slide members. A slide member and a groove have preferably "L" shaped transverse cross-sectional portions which effects locking of the respective slide member in the respective groove against lateral motion or deformation release. The latch device includes a manually selectively moveable detent on either a slide member or a groove, and a shoulder forming member on the other of the slide member and groove such that the detent is selectively retained against movement by engagement with the shoulder forming member. Thus, by sliding the slide member into its respective groove and engaging the detent with the shoulder forming member, a cowling member is releasably secured to the frame member forming a portion of the holster and holster pocket. By moving the detent, which detent is adapted for such manual toolless movement, away from the shoulder forming member, the cowling member is decoupled and removable from the frame member, after which a second cowling member can be coupled to the frame member in a similar fashion as described above to form a holster with a different holster pocket configuration.

Another embodiment of the present invention provides a holster including a frame member which forms a first portion of a holster and holster pocket, and an interchangeable cowling member which is cooperatively associated with the frame member and which forms a second portion of a holster and holster pocket. There is at least one groove in either the frame member or cowling member, and at least one corresponding slide member on the other of the frame member or cowling member. Each groove is adapted to receive its respective slide member for selective longitudinal movement therein. The holster further includes a latch device having a first portion cooperating with the frame member and a second portion cooperating with the cowling member. The latch device is operable to selectively limit movement of the slide members in the grooves thereby releasably coupling the cowling member to the frame member.

Another embodiment of the present invention provides a holster including a frame member which forms a first portion of a holster and holster pocket, which frame member is sized and configured to receive the top portion of a pistol barrel therein, and an interchangeable cowling member which forms a second portion of a holster and holster pocket, which cowling member is sized and configured to receive a mid or lower portion of a pistol therein. The holster also includes a latch device having a first portion which cooperates with and is coupled to the frame member and a second portion which cooperates with and is coupled to the cowling member. The latch device is operable to selectively couple the frame member to the cowling member and is adapted for toolless coupling and decoupling.

Another embodiment of the present invention provides a holster pocket alteration method including disengaging a first cowling member from securement to a frame member, where the first cowling member and frame member previously defined at least part of a first holster pocket having a first configuration, by toollessly decoupling a latch device first portion cooperating with and coupled to the frame member from a latch device second portion cooperating with and coupled to the first cowling member. The holster pocket alteration method further includes securing a second cowling member to the frame member by toollessly coupling the latch device first portion to a latch device second portion cooperating with and coupled to the second cowling member such that the second cowling member and the frame member at least partially form a second holster pocket having a second configuration.

Another embodiment of the present invention includes a holster kit including a frame member and a first cowling member, where the first cowling member is selectively coupleable to the frame member. When coupled, the frame member and first cowling member form at least a portion of a first holster pocket. The holster kit further includes a first latch device with a first portion cooperating with the frame member and a second portion cooperating with the first cowling member. The first latch device is operable to selectively couple the frame member to the first cowling member, which first latch device is adapted for decoupling. Additionally, the holster kit includes a second cowling member for coupling with the frame member and a second latch device having a second portion cooperating with the second cowling member and the first portion cooperating with the frame member, and operable to selectively couple and decouple the frame member to the second cowling member. The frame member and said second cowling member forming a portion of a second holster pocket.

BRIEF DESCRIPTION OF THE DRAWINGS

For a better understanding of embodiments of the present invention, reference may be made to the accompanying drawings, wherein like numbers refer to like or similar parts and/or construction, and numbers which are followed by an "A" (e.g. 120A) refer to similar components with similar functions and usage as compared to components numbered without an "A" suffix.

DETAILED DESCRIPTION

Figure 3:
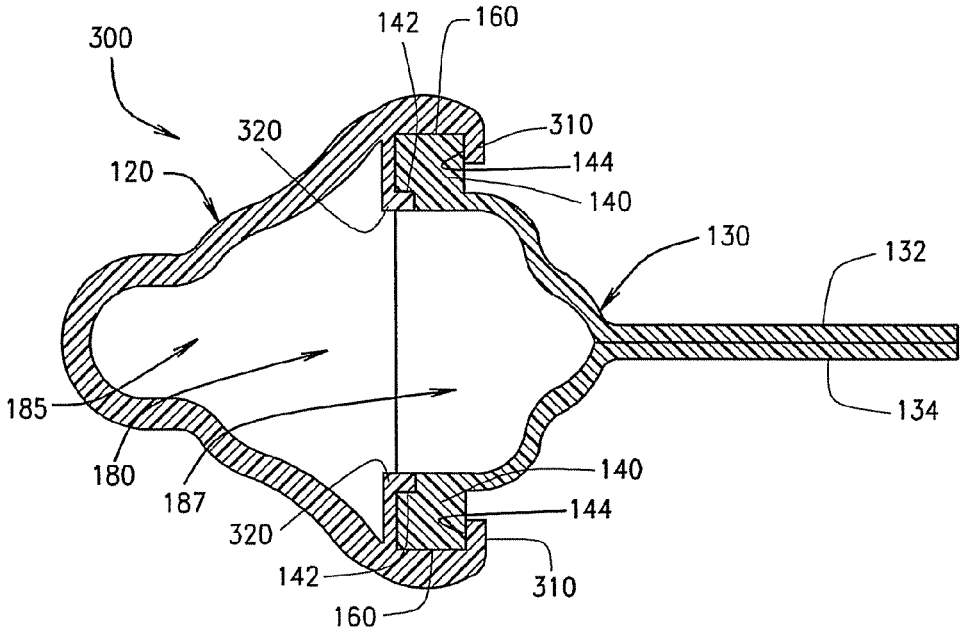
FIG. 3 is a cross-sectional view taken along line 3-3 of FIG. 1 showing the cowling member coupled to the frame member, with slide members engaged in their respective grooves.
Figure 4:
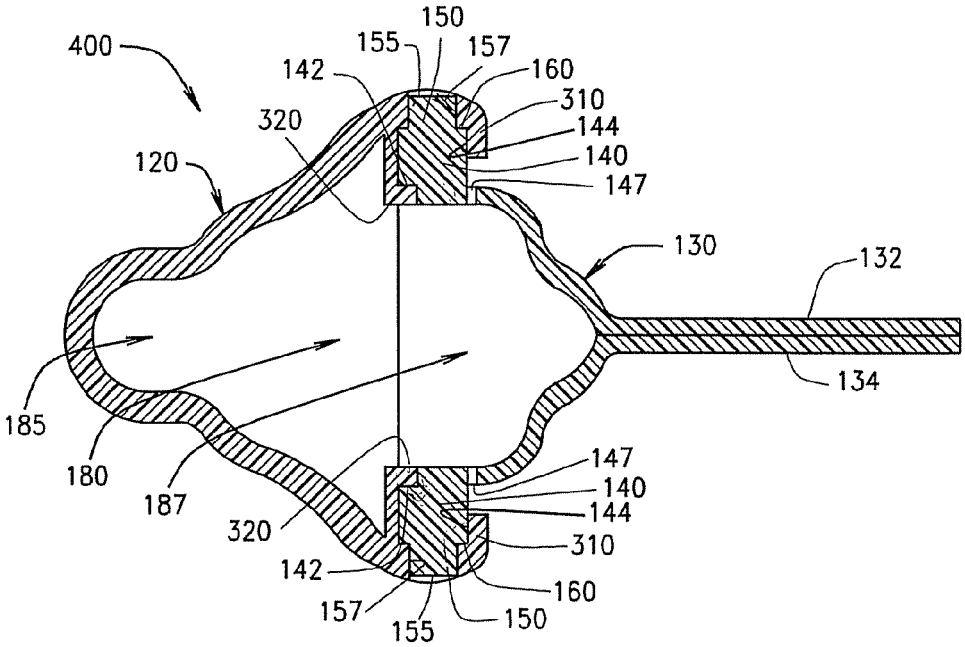
FIG. 4 is a cross-sectional view taken along line 4-4 of FIG. 1 showing the cowling member coupled to the frame member, with manually toollessly selectively moveable detents engaged with shoulder forming members.
Figure 5:
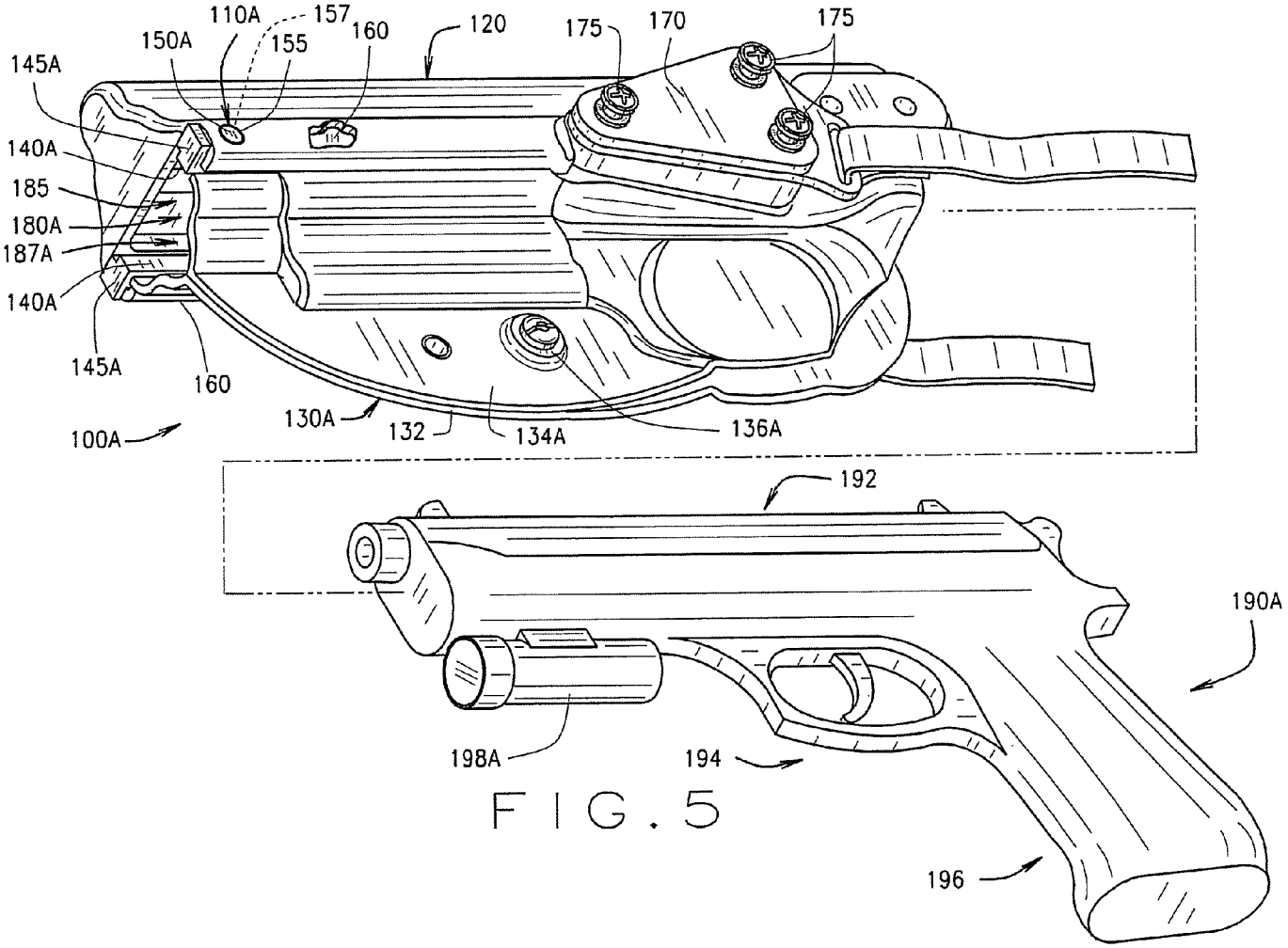
FIG. 5 is an exploded perspective view of another embodiment of the present invention similar to that shown in FIG. 1, but wherein a different cowling member is coupled to the frame member to form a different holster and holster pocket, the cowling member being adapted to hold a firearm similar to that shown in FIG. 1 but with an added barrel mounted accessory attached thereto.

The present invention includes a first shape configurable holster 100 as illustrated in FIGS. 1-4 and a second modified holster 100A as illustrated in FIG. 5. Holster 100 is preferably molded out of nylon or other polymer at about ⅛ inch in thickness for rigidity, which can be reinforced if desired. In this regard, it is recognized and anticipated that other suitable materials may likewise work equally as well including other thicknesses. The holster 100 includes a latch device 110, a frame member 120 and a cowling member 130. Modified holster 100A includes a latch device 110A, the same frame member 120 and a different cowling member 130A. A user of the holster 100 can couple and decouple the cowling member 130 to the frame member 120 with the latch device 110, which latch device 110 is adapted for toolless coupling and decoupling as will be hereinafter further explained. A user of modified holster 100A can couple and decouple the cowling member 130A to the frame member 120 with the latch device 110A, which latch device 110A is likewise adapted for toolless coupling and decoupling of the frame member 120 to the cowling member 130A. Because of the present invention as will be hereinafter further explained, a user can easily and quickly interchange cowling members 130 and 130A as needed.

Figure 1:
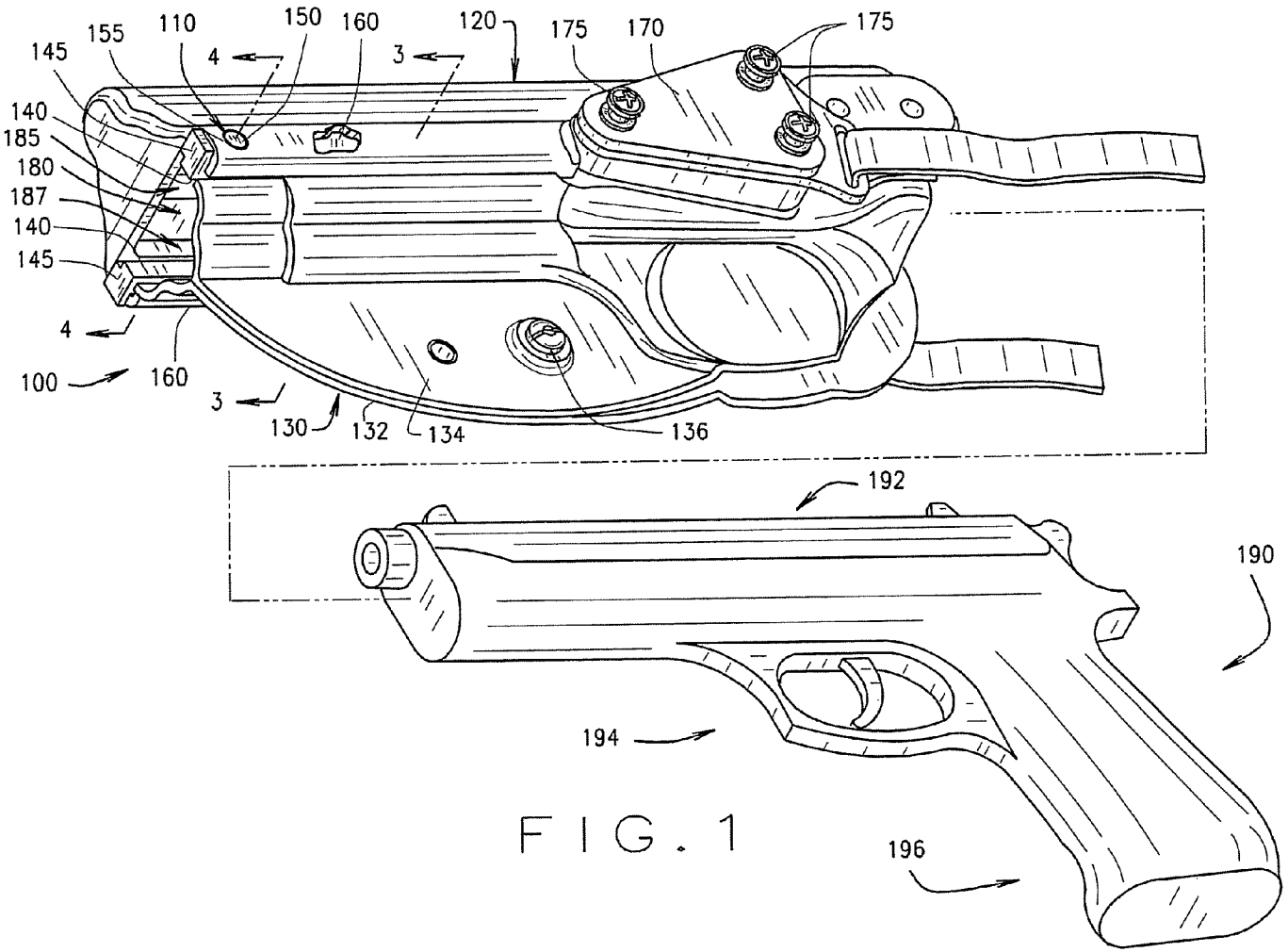
FIG. 1 is an exploded perspective view of one embodiment of the present invention showing a cowling member coupled to a frame member and a removed pistol.
Figure 2:
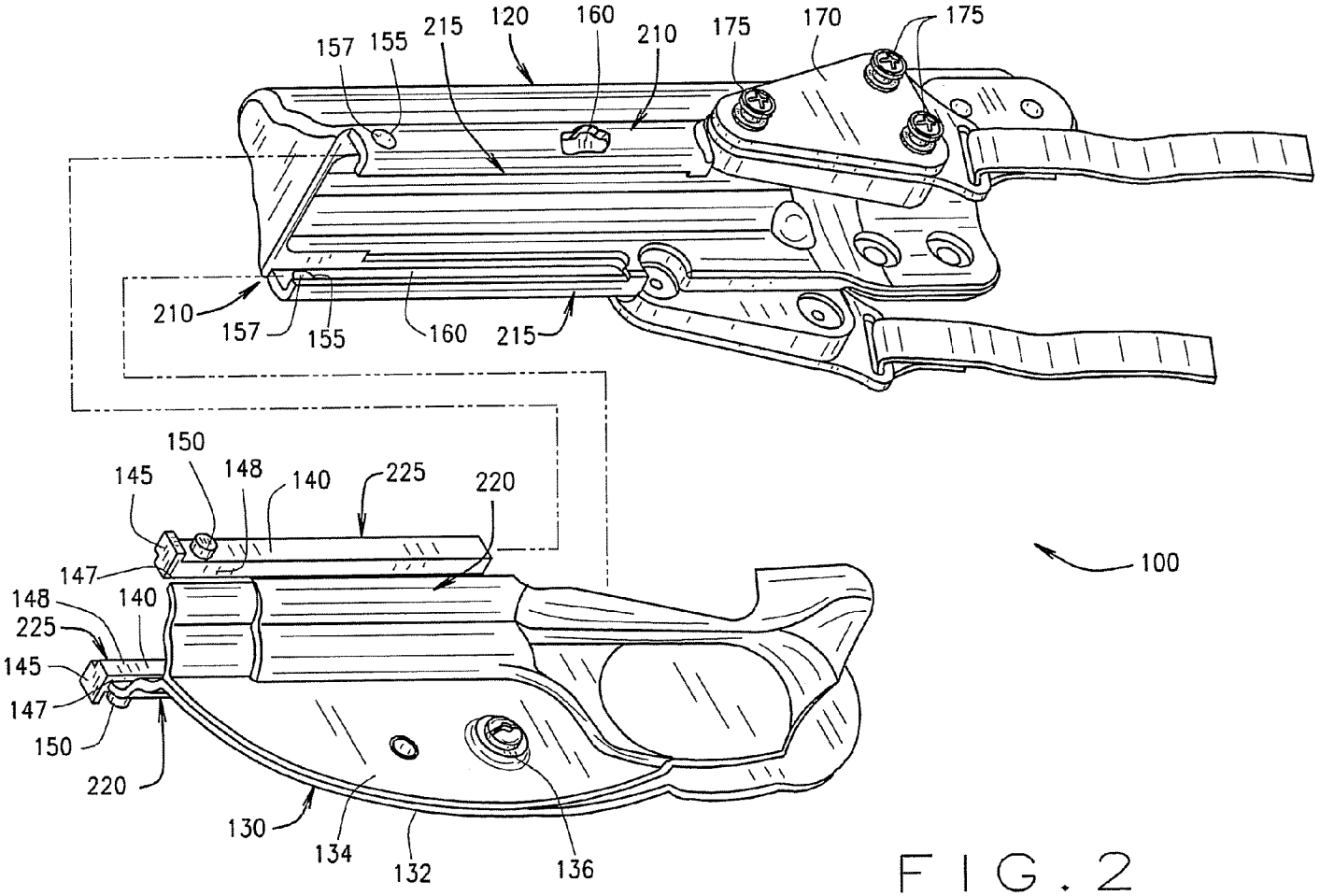
FIG. 2 is an exploded perspective view similar to FIG. 1 showing the cowling member and frame member of FIG. 1 decoupled.

FIG. 1 illustrates a holster 100 with interchangeable cowling member 130 according to one embodiment of the present invention. As shown, the holster 100 includes a latch device 110, a frame member 120 and a cowling member 130. The cowling member 130 has a right portion 132 and a left portion 134, and may be of a multiple piece construction. If the cowling member 130 is of a multiple piece construction, it can utilize a fastener 136 to secure the left portion 134 to the right portion 132 as shown. The cowling member 130 further includes slide members 140 having tabs 145 and detents 150 associated therewith. Each slide member 140 also includes a movement assisting gap 147 and a distal end portion 148 as shown in FIG. 2. The frame member 120 includes shoulder forming members 155 and grooves 160. The frame member 120 may further include an attachment bracket 170 which, as illustrated, includes fasteners 175 for attaching the overall holster to a particular mounting platform. The latch device 110 includes the detents 150 and shoulder forming members 155. The frame member 120 and cowling member 130, when coupled, define an internal holster pocket 180. The holster pocket 180 includes a barrel channel portion 185 and a mid portion 187. The pistol 190 includes a top or barrel portion 192, a mid portion 194, and a handle portion 196.

As shown in FIGS. 1 and 2, the left portion 134 and right portion 132 of the cowling member 130 are physically attached together by the fastener 136. The terms "left" and "right" are used above only to differentiate the sides of the cowling member for description purposes only. As is more easily seen in FIG. 2, the slide members 140 extend from the cowling member 130 generally parallel to the longitudinal axis of the barrel channel portion 185 of the holster pocket 180, and the tabs 145 extend perpendicularly from the ends of the slide members 140. A detent 150 extends perpendicularly from a respective slide member 140. Preferably, a detent 150 is positioned adjacent to the tab 145 at the distal end of each slide member 140, and the slide member 140 has a portion separated from the cowling member 130 toward the distal end portion 148 thereof by movement assisting gap 147 such that the distal end portion 148 of each slide member 140 is cantilevered to permit bending and movement of the detents 150 into and out of the shoulder forming members 155. The grooves 160 extend along the frame member 120 generally parallel to the longitudinal axis of the pocket portion of the barrel channel portion 185 of the holster pocket 180, and the shoulder forming members 155 are located along the grooves 160. The shoulder forming members 155 may include the openings or holes 157 for receiving the detents 150 as will be hereinafter explained.

As illustrated in FIGS. 1 and 2, the slide members 140 run generally along the length of the cowling member 130 and the grooves 160 run generally along the length of the frame member 120 on opposite lateral sides of the holster pocket 180, with the grooves 160 positioned on either side of the frame member 120 and the slide members 140 positioned on either side of the cowling member 130. The latch device 110 selectively couples the cowling member 130 to the frame member 120 and, as shown, includes the detents 150 and shoulder forming members 155. The frame member 120 and cowling member 130, when coupled, define an internal holster pocket 180 with a barrel channel portion 185 and a mid portion 187. The holster pocket 180 is adapted to receive a pistol 190 therein, where the barrel channel portion 185 is adapted to receive at least the top (barrel) portion 192 of the pistol 190 therein, and the mid portion 187 is adapted to receive the pistol mid portion 194 therein.

The attachment bracket 170 is attached to the frame member 120, as shown, by suitable fasteners 175, which can also assist in releasably attaching the holster 100 to a particular mounting platform. In operation, the attachment bracket 170 and fasteners 175 are structured, positioned and located so as to be compatible for attachment to a particular mounting platform, for example, on a belt or harness (not shown). The attachment bracket 170 and fasteners 175 are reversible so that they can be mounted for a left-side holster wearer or a right-side holster wearer.

Each groove 160 of the frame member 120 receives a respective slide member 140 for longitudinal movement therein. Once the slide members 140 have been inserted into the respective grooves 160 (i.e. one slide member 140 per groove 160) sufficiently for the detents 150 to abut the frame member 120 at the open ends of the grooves 160, the detents 150 selectively prevent further insertion of the slide members 140 into the grooves 160. The distal end portions 148 of the slide members 140 are preferably elastically, or resiliently, deformable by a user pinching the tabs 145 inwardly between, for example, two digits such as a thumb and finger, at the ends of the slide members 140 such that a detent 150 at the end of each slide member 140 no longer abuts the frame member 120 at the ends of the grooves 160. The bending of the slide members 140 allows the slide members 140 of the cowling member 130 to be further inserted into the grooves 160 of the frame member 120.

In the embodiment illustrated in FIGS. 1 and 2, the shoulder forming member 155 includes an opening or hole 157, each hole 157 being sized and shaped to receive the respective detent 150 therein. When the slide member 140 is further moved in its respective groove 160 such that the inwardly pinched detent 150 is positioned for insertion into a respective hole 157 associated with its respective shoulder forming member 155, the user releases the tabs 145, allowing the slide members 140 to elastically return to their normal positions thereby allowing the detents 150 to be received within the holes 157 and to be retained in place by the shoulder forming members 155. The detents 150 are selectively resiliently moveable and the shoulder forming members 155 retain the detents 150 against movement in and out of or along a respective groove 160. Thus, the detents 150 and shoulder forming members 155 are adapted for toolless coupling and decoupling. Toolless means coupling and decoupling manually by a human without the assistance of a separate tool or other mechanism. However, this construction also allows a tool to be used if needed, for example, if ice or debris prevents the toolless coupling or decoupling of the cowling member 130 and frame member 120. In this regard, a pointed object can be used to push a detent 150 out of cooperative engagement with the shoulder forming member 155.

Once the cowling member 130 is selectively coupled to the frame member 120, the holster 100 defines an internal holster pocket 180 with a barrel channel portion 185 and a mid portion 187, where the barrel channel portion 185 is adapted to receive a pistol barrel portion 192, and the mid portion 187 is adapted to receive a pistol mid portion 194 therein. Although the embodiment of FIGS. 1 and 2 utilize a hole 157 associated with each shoulder forming member 155 to engage the respective detents 150, it is recognized and anticipated that the shoulder forming members 155 may include a wide variety of other means such as a flange, a projection, a slot, an indentation, or some other mechanism for engaging the detents 150 and preventing further longitudinal movement of the slide members 140 within the grooves 160. It is further recognized that the detents 150 and openings 157 can likewise be replaced with any mutually interengageable surfaces, or any abutting shoulder portions which will prevent or limit relative longitudinal movement between the frame member 120 and cowling member 130.

Alternatively, the cowling member 130 may be a unitary piece or more than two pieces, as opposed to being constructed with the left portion 134 coupled to the right portion 132 via the fastener 136. The fastener 136 may be any suitable device which secures the left portion 134 to the right portion 132, where the use of the two portions 132 and 134 facilitates the molding thereof. The left and right portions 132, 134 may also be welded or glued together, or may be otherwise fastened together. The detents 150 may alternatively be part of the frame member 120 and may be positioned in the grooves 160 as opposed to being associated with the slide members 140. The shoulder forming members 155 may similarly alternatively be associated with the slide members 140 as opposed to along the grooves 160, or anywhere else that could achieve selectively locking of the cowling member 130 to the frame member 120. The detents 150 and shoulder forming members 155 may likewise be of any shape that could achieve selectively locking of the cowling member 130 to the frame member 120, such as a tapered lead in. The detents 150 and shoulder forming members 155 may alternatively be positioned anywhere on the cowling member 130 or frame member 120 so as to achieve selective locking of the respective members. In alternative embodiments, any of the slide members 140 and grooves 160 may be provided on the cowling member 130 and frame member 120 such that (1) both slide members 140 are positioned on the cowling member 130 and both grooves are positioned on the frame member 120, or (2) both slide members 140 are positioned on the frame member 120 and both grooves 160 are positioned on the cowling member 130, or (3) the cowling member 130 includes one groove 160 and one slide member 140 while the frame member 120 includes the other groove 160 and other slide member 140. Still further, the grooves 160 and slide members 140 may alternatively be perpendicular to the longitudinal axis of the barrel channel portion 185 of the holster pocket 180, or they may be at any other suitable angle at which the slide members 140 are insertable into the grooves 160 to effectuate releasable mounting of the cowling member 130 to the frame member 120. Alternatively, there may be only one slide member 140 and one groove 160, or more than two slide members 140 and more than two grooves 160, so long as the arrangement is sufficient to effectuate releasable mounting of the cowling member 130 to the frame member 120.

The grooves 160 and slide members 140 may be any shape that effectuates locking of the cowling member 130 in the frame member 120 and are preferably configured so as to prevent lateral movement of the cowling member 130 in the frame member 120, such as by using a slide member 140 and corresponding groove 160 having generally "L" shaped transverse cross-sectional portions or other mutually interengageable mating surfaces as shown in FIGS. 3 and 4. The tabs 145 may be any suitable shape and size so long as they can assist the user in toollessly effectuating coupling and decoupling of the cowling member 130 and the frame member 120.

FIG. 2 illustrates an exploded perspective view of a holster 100 with interchangeable cowling member 130 according to one embodiment of the present invention. The holster 100 in FIG. 2 is shown as including the frame member 120, cowling member 130, right portion 132, left portion 134, fastener 136, slide members 140, tabs 145, detents 150, shoulder forming members 155 which include holes 157 (the detents 150 and shoulder forming members 155 forming the latch device 110), grooves 160, attachment bracket 170, and fasteners 175 as shown above in FIG. 1. The barrel channel portion 185 is as shown in FIG. 1 above. The holster 100 with interchangeable cowling member 130 also includes movement assisting gaps 147 and first side panels 210 having distal first edge portions 215 on the frame member 120. The cowling member 130 further includes second side panels 220 having distal second edge portions 225. The first and second side panels 210, 220 are positioned to receive a portion of a pistol therebetween, for example, the mid portion 194 and lower part of the barrel portion 192 of a pistol 190.

In addition to that discussed in relation to FIG. 1, the slide members 140 extend from distal second edge portions 225 of the second side panels 220 of the cowling member 120 generally parallel to the longitudinal axis of the pocket portion of the barrel channel portion 185 of the holster pocket 180. The grooves 160 extend along the distal first edge portions 215 of the first side panels 210 of the frame member 110 generally parallel to the longitudinal axis of the pocket portion of the barrel channel portion 185 of the holster pocket 180. The slide members 140, being partially separated from the cowling member 130 by the movement assisting gaps 147 discussed above, are thus cantilevered in a preferred embodiment. The movement assisting gaps 147 can be about 1 inch long.

FIGS. 3 and 4 illustrate cross-section views of holster 100 with interchangeable cowling member 130 taken along lines 3-3 and 4-4 of FIG. 1 according to one embodiment of the present invention. As shown, the cross-section of the holster includes a frame member 120, cowling member 130, and slide members 140 each having slide member surfaces 142, 144. The slide members 140 are partially separated from the cowling member 130 along the gap 147. The frame member 120 includes grooves 160 each of which are defined by a lower rib (or flange) 310 and an upper rib (or flange) 320. The grooves 160 extend along the frame member 120 perpendicular to the page and are partially defined by the lower flanges 310 and the upper flanges 320. Detents 150 project from the slide members 140 and shoulder forming members 155 are located along the grooves 160 as shown in FIGS. 1 and 2. The holster 100 in FIGS. 3 and 4 is also shown as including the right cowling portion 132 and left cowling portion 134 which operate and are connected as previously described above in relation to FIG. 1.

In operation, as discussed above, the grooves 160 in the frame member 120 receive their respective slide members 140 associated with the cowling member 130 for longitudinal movement therealong. Once the slide members 140 are inserted into the grooves 160, the lower flanges 310 and upper flanges 320 prevent lateral movement of the cowling member 130 in the frame member 120, while the rigidity of the frame member 120 and cowling member 130 further prevent lateral movement of the cowling member 130 in the frame member 120 via engagement with slide member surfaces 142, 144. Thus, the grooves 160 and slide members 140 have transverse cross sectional shapes which effectuate locking of each of the slide members 140 in their respective grooves 160 against lateral motion release, i.e. lateral or inward movement of the slide members 140 out of the grooves 160. Further, the grooves 160, slide members 140 and latch device 110, which prevents longitudinal movement of the cowling member 130 in the frame member 120, assist in releasably mounting the cowling member to the frame member. In this regard, the shoulder forming members 155 may each include a hole or opening 157, each sized and shaped to receive a respective detent 150 therein. When the slide members 140 of the cowling member 130 are correctly positioned in the grooves 160, the detent 150 on each respective slide member 140 is received and retained in place by a through hole 157 of a respective shoulder forming member 155, which engagement prevents longitudinal movement of the slide members 140 in the grooves 160. Once the cowling member 130 is selectively coupled to the frame member 120, the holster 100 defines an internal holster pocket 180 to receive a pistol 190 therein, where the internal holster pocket 180 includes the barrel channel portion 185 adapted to receive a barrel portion 192 of a pistol 190 therein.

Alternatively, the upper flanges 320 and lower flanges 310 may be positioned other than as shown so long as the configuration of the grooves 160 can still prevent the slide members 140 from moving laterally in the grooves 160 once inserted therewithin. Similarly, there may alternatively be only one, or more than two, upper flanges 320 and lower flanges 310 so long as the arrangement is sufficient to prevent lateral movement of the cowling member 130 within the frame member 120. At least a part of the holster may be made of a rigid polymer, or any other similarly rigid material.

FIG. 5 illustrates a modified holster 100A with cowling member 130A attached thereto according to one embodiment of the present invention. Cowling member 130A is similar to cowling member 130 in many constructional aspects but, when coupled to the frame member 120, is configured, adapted and dimensioned to accommodate at least the lower portion of a pistol with an attached accessory such as a below-the-barrel mounted flashlight 198A. As shown, the modified holster 100A includes a latch device 110A, frame member 120 and a cowling member 130A. As with cowling member 130, cowling member 130A may be of a multiple piece construction having a right portion 132A, a left portion 134A and a fastener 136A as previously explained. The cowling member 130A further includes slide members 140A, tabs 145A, and detents 150A. The frame member 120, which is similarly constructed as previously described, includes shoulder forming members 155, openings 157 and grooves 160 as previously described. The frame member 120 may likewise include the optional attachment bracket 170 as previously explained. The latch device 110A includes the detents 150A and shoulder forming members 155. The frame member 120 and cowling member 130A, when coupled, define an internal holster pocket 180A. The holster pocket 180A includes a barrel channel portion 185 and a mid portion 187A. The pistol 190A includes a top or barrel portion 192, a mid portion 194, a handle portion 196, and an attachment accessory 198A. The holster pocket 180A is adapted to receive a pistol 190A with an attachment accessory 198A (shown as a below-the-barrel mounted flashlight), and the barrel channel portion 185 is adapted to receive the barrel portion 192 of a pistol 190A therein. Cowling member 130A may be configured and dimensioned to house and/or accept pistol 190A with any attachment accessory associated therewith, which may include, in addition to the barrel mounted flashlight 198A, a night sight, a laser sight, a camera, or any other attachment accessory. In addition, the cowling member 155 may be configured to house and/or accept a differently shaped pistol.

As shown, the left cowling portion 134A, right cowling portion 132A, fastener 136A, slide members 140A, tabs 145A, detents 150A, and latch device 110A are all connected and all function like their respective components as previously described with respect to FIGS. 1 and 2 above, as is likewise true of frame member 120 and its components. In operation, the cowling member 130A functions similarly to cowling member 130 illustrated in FIGS. 1-4, except that when the cowling member 130A is coupled to the frame member 120, the holster pocket 180A is adapted to receive a pistol with an attachment accessory 198A attached thereto, such as a below-the-barrel mounted flashlight.

All of the described alternatives for the holster 100 in FIG. 1 are equally applicable to the modified holster 100A in FIG. 5. Additionally, the holster pocket 180A may be easily reconfigured to receive a pistol with any type of add-on accessory attached thereto, such as a laser sight, a night sight, camera mounted to the pistol, or other such device. Upon deciding to add such an attachment to the pistol, a user of holster 100 shown in FIGS. 1 and 2 can toollessly decouple the cowling member 130 from the frame member 120, which previously defined a first holster pocket 180 having a first configuration, and can toollessly couple the cowling member 130A to the frame member 120, which forms a second holster pocket 180A with a second configuration adapted to receive a pistol with a particular attachment accessory associated therewith. This allows the user to holster the firearm with an accessory attached thereto. Also, latch device 110A may alternatively be latch device 110.

One or more embodiments of the present invention allow for the toolless coupling and decoupling of various cowling members 130 and 130A to a single frame member 120, such that each cowling member, in combination with the same frame member, can form a different holster and different holster pocket for accepting the various configurations of a single firearm, or for accepting various firearms. This toolless coupling and decoupling is much faster, easier, and less expensive than the previous options of carrying completely separate holsters for each handgun variant or for each different handgun, or carrying the tools required to attempt to alter previous holsters.

In addition, the various cowling members such as the members 130 and 130A associated with the present invention along with the frame member 120 can also be provided in kit form along with suitable instructions for coupling and decoupling the various cowling members to the same frame member. In this regard, any number of cowling members 130 and 130A can be provided in such a holster kit for providing various holster pocket configurations adaptable for accommodating one pistol having a wide variety of different accessory attachments associated therewith, or differently configured pistols requiring respectively different holster pockets. As described above, the frame member and each cowling member associated with any such kit would include a latch mechanism as described above associated with both the frame member and each respective cowling member.

While particular elements, embodiments, and applications of the present invention have been shown and described, it is understood that the present invention is not limited thereto as many changes, modifications, variations and other uses and applications of the present invention may be made by those skilled in the art, particularly in light of the foregoing teaching. It is therefore contemplated by the appended claims to cover all such changes, modifications, variations and other uses and applications and to incorporate those features which come within the spirit and scope of the present invention.

What is claimed is:

1. A holster comprising:

a frame member forming a first portion of a holster pocket;

a cowling member cooperatively associated with the frame member and forming a second portion of the holster pocket;

at least one slide member including a first slide member on one of the frame member and cowling member;

at least one groove including a first groove in the other of the frame member and cowling member, said first groove being adapted to receive said first slide member for selective longitudinal movement therealong;

a first latch device having a first portion associated with the at least one first slide member and cooperating with one of the frame member and cowling member and a second portion associated with the other of the frame member and cowling member and cooperating with the at least one first slide member, said first portion being resiliently movable in a transverse direction to the longitudinal movement of said at least one first slide member to selectively prevent movement of said first slide member in said first groove, said first groove, said first slide member and said first latch device toollessly releasably mounting the cowling member to the frame member; and a first tab extending from a distal end of said at least one first slide member, said first tab being movable in a transverse direction relative to the longitudinal movement of said at least one first slide member, wherein when said first tab moves in a transverse direction relative to the longitudinal movement of said at least one first slide member, a portion of said first latch device also moves in the transverse direction.

2. The holster of claim 1 wherein said frame member being configured to receive a top portion of a pistol in the first portion of the holster pocket and the cowling member being adapted to receive a lower portion of a pistol in the second portion of the holster pocket, where the portion of the holster pocket being configured to receive the top portion of the pistol including the barrel channel portion of the holster.

3. The holster of claim 1 wherein:

said frame member further including one of a second said groove and a second said slide member;

said cowling member further including the other of said second groove and said second slide member, wherein said second groove being adapted to receive said second slide member for selective longitudinal movement therealong; and a second latch device having a first portion associated with said second slide member and cooperating with one of said frame member and said cowling member and a second portion associated with the other of said frame member and said cowling member and cooperating with said second slide member, said first portion being resiliently movable in a transverse direction to the longitudinal movement of said second slide member, said second groove, said second slide member and said second latch device further assisting in releasably mounting the cowling member to the frame member; and a second tab extending from a distal end of said second slide member, said second tab being movable in a transverse direction relative to the longitudinal movement of said second slide member, wherein when said second tab moves in a transverse direction relative to the longitudinal movement of said at least one second slide member, a portion of said second latch device also moves in the transverse direction.

4. The holster of claim 3 wherein the first and second grooves and first and second slide members having transverse cross sectional shapes which effect locking of each of the slide members in a respective said groove against lateral motion release of a said slide member from a respective said groove.

5. The holster of claim 4 wherein the grooves and slide members having generally L shaped transverse cross sectional portions.

6. The holster of claim 3 wherein the grooves and the slide members each having a longitudinal axis running generally along a portion of the length of the frame member and cowling member with the first groove and respective first slide member being positioned on one side of the holster pocket and the second groove and respective second slide member being positioned on an opposite side of the holster pocket.

7. The holster of claim 6 wherein the longitudinal axis of each of the grooves and the slide members being generally parallel to a longitudinal axis of a barrel channel portion of said holster.

8. The holster of claim 4 wherein the frame member including a pair of spaced apart first side panels each on an opposite side of the holster pocket each with a distal first edge portion in spaced apart relationship from one another, said cowling including a pair of spaced apart second side panels each on an opposite side of the holster pocket and each with a distal second edge portion in spaced apart relationship from one another and wherein at least one of said grooves being in at least one of the first and second side panels and at least one of said slide members being in at least one of the other of said first and second side panels, said spaced apart first side panels and said spaced apart second side panels being positioned to receive a portion of a pistol therebetween.

9. The holster of claim 8 wherein the grooves being positioned along one of a respective first and second edge portion and said slide members being positioned along a respective other of the first and second edge portions.

10. The holster of claim 3 wherein the first portion of said first latch device includes a first manually selectively resiliently movable detent located adjacent to said first tab and the second portion includes a first shoulder forming member, the first detent being selectively retained against movement by engagement with said first shoulder forming member.

11. The holster of claim 10 wherein the second latch device further includes a second manually selectively resiliently movable detent located adjacent to said second tab associated with said second slide member and a second shoulder forming member associated with said cowling member, the second detent being selectively retained against movement by engagement with said second shoulder forming member.

12. The holster of claim 1 wherein one of the frame member and cowling member being composed of a rigid polymer.

13. The holster of claim 11 wherein said first and second shoulder forming members include an opening for receiving said first and second detents.

14. A holster comprising:

a frame member forming a first portion of a holster pocket sized and configured to receive a top portion of a pistol barrel therein;

a cowling member forming a second portion of said holster pocket sized and configured to receive a lower portion of a pistol barrel therein;

at least one slide member including a first slide member on one of the frame member and cowling member having a detent and a first tab associated therewith;

at least one groove including a first groove in the other of the frame member and cowling member, said first groove being adapted to receive said first slide member for selective longitudinal movement therealong, said first groove including a shoulder forming member for engaging said detent;

said first tab extending from a distal end of said first slide member, said first tab being movable in a transverse direction relative to the longitudinal movement of said first slide member; wherein when said first tab moves in a transverse direction relative to the longitudinal movement of said first slide member, said detent also moves in the transverse direction;

said detent being movable in a transverse direction relative to the longitudinal movement of said first slide member for selectively engaging and disengaging said shoulder forming member, said detent being selectively retained against movement by engagement with said shoulder forming member thereby preventing movement of said first slide member in said first groove, engagement of said detent with said shoulder forming portion operatively coupling said frame member to said cowling member.

15. The holster of claim 14 further including:

a second said groove associated with one of said frame member and said cowling member and a second said slide member associated with the other of said frame member and said cowling member, said second groove including a shoulder forming member for engaging a detent associated with said second slide member;

said second groove being adapted to receive said second slide member for selective longitudinal movement therealong, said detent being movable in a transverse direction relative to the longitudinal movement of said second slide member for selectively engaging and disengaging said shoulder forming member, said detent being operable to selectively prevent movement of said second slide member in said second groove;

said second slide member further including a second tab, said second tab extending from a distal end of said second slide member, said second tab being movable in a transverse direction relative to the longitudinal movement of said second slide member, wherein when said second tab moves in a transverse direction relative to the longitudinal movement of said second slide member, said detent associated with said second slide member also moves in the transverse direction.

16. The holster of claim 15 wherein the first and second grooves and first and second slide members having transverse cross sectional shapes which effect locking of each of the slide members in a respective said groove against lateral motion release of a said slide member from a said groove.

17. The holster of claim 16 wherein the grooves and slide members having generally L shaped transverse cross sectional portions.

18. The holster of claim 15 wherein the grooves and the slide members each having a longitudinal axis running generally along a portion of the length of the frame member and cowling member with the first groove and respective first slide member being positioned on one side of the holster pocket and the second groove and respective second slide member being positioned on an opposite side of the holster pocket, where the longitudinal axis of each of the grooves and the slide members being generally parallel to the longitudinal axis of a barrel channel portion of said holster.

19. The holster of claim 16 wherein the frame member including a pair of spaced apart first side panels each on an opposite side of the holster pocket each with a distal first edge portion in spaced apart relationship from one another, said cowling member including a pair of spaced apart second side panels each on an opposite side of the holster pocket and each with a distal second edge portion in spaced apart relationship from one another and wherein at least one of said grooves being in at least one of the first and second side panels and at least one of said grooves being in at least one of the other of said first and second side panels, said spaced apart first side panels and said spaced apart second side panels being positioned to receive a portion of a pistol therebetween.

20. The holster of claim 19 wherein the grooves being positioned along one of a respective first and second edge portion and the said slide members being positioned along a respective other of the first and second edge portions.

21. The holster of claim 14 wherein said shoulder forming member including an opening.

22. A holster kit comprising:

a frame member;

a first cowling member for coupling with the frame member, said frame member and said first cowling member, when coupled, forming at least a portion of a first holster pocket, the first cowling member including a tab;

a first latch device having a first portion cooperating with the frame member and a second portion cooperating with the first cowling member, and operable to selectively couple the frame member to the first cowling member for toolless decoupling;

a second cowling member for coupling with the frame member, said frame member and said second cowling member forming a portion of a second holster pocket, the second cowling member including a tab;

a second latch device having a said second portion cooperating with the second cowling member, and operable to selectively couple the frame member to the second cowling member for toolless decoupling;

wherein the first and second latch devices each including a manually selectively resiliently movable detent on one of the frame member and cowling member and a shoulder forming member on the other of the frame member and cowling member, the detents being selectively retained against movement by engagement with the respective shoulder forming member, the detents being movable in a direction transverse to the longitudinal axis of said frame member by movement of each respective tab.

23. A holster comprising:

a frame member forming a first portion of a holster pocket;

a cowling member cooperatively associated with the frame member and forming a second portion of the holster pocket;

at least one slide member including a first slide member on one of the frame member and cowling member;

at least one groove including a first groove in the other of the frame member and cowling member, said first groove being adapted to receive said first slide member for selective longitudinal movement therealong;

said at least one slide member including a movement assisting gap extending at least partially between said one slide member and one of the frame member and cowling member for allowing movement in a transverse direction to the longitudinal movement of said at least one slide member;

a latch device having a first portion cooperating with the frame member and a second portion cooperating with the cowling member and operable to selectively prevent movement of said first slide member in said first groove, said first groove, said first slide member and said latch device releasably mounting the cowling member to the frame member.

* * * * *